US007098391B2

(12) United States Patent
Wilson

(10) Patent No.: US 7,098,391 B2
(45) Date of Patent: Aug. 29, 2006

(54) PROTECTIVE SLEEVE FOR AN INSTRUMENT STRING AND ITS METHOD OF APPLICATION TO AN INSTRUMENT

(76) Inventor: Edward Wilson, 59 Ridgewood Ave., Ewing, NJ (US) 08618

( * ) Notice: Subject to any disclaimer, the term of this patent is extended or adjusted under 35 U.S.C. 154(b) by 0 days.

(21) Appl. No.: 10/741,973

(22) Filed: Dec. 20, 2003

(65) Prior Publication Data

US 2004/0129129 A1 Jul. 8, 2004

Related U.S. Application Data

(63) Continuation-in-part of application No. 09/776,597, filed on Feb. 5, 2001, now abandoned.

(51) Int. Cl.
*G10G 3/00* (2006.01)

(52) U.S. Cl. ..... 84/453

(58) Field of Classification Search ..... 84/297 R, 84/298, 299, 297 S, 307
See application file for complete search history.

(56) References Cited

U.S. PATENT DOCUMENTS 572,677 A * 12/1896 Goodwin ..... 84/297 R
4,535,670 A * 8/1985 Borisoff ..... 84/312 R
5,227,571 A * 7/1993 Cipriani ..... 84/307
5,477,764 A * 12/1995 Carrico ..... 84/297 R

* cited by examiner

*Primary Examiner*—Kimberly Lockett
(74) *Attorney, Agent, or Firm*—Lamorte & Associates

(57) ABSTRACT

A device and method for reducing wear and stress in the string of a stringed instrument, such as a guitar. Certain stringed instruments are strung by advancing strings through string apertures in the body of the instrument. The device includes tubular sleeves that are placed into the string apertures. As the instrument is strung, the strings of the instrument are tightened. When tightened, the strings abut against and bend around the tubular sleeve. The tubular sleeve has a curved surface against which the strings bend. This lowers stress concentrations in the strings at the points of the bend. Furthermore, the tubular sleeves are made from a material that is softer than the material of the instrument's strings. Accordingly, as the instrument's strings wear against the sleeves, the sleeves experience the wear more so than the strings.

6 Claims, 4 Drawing Sheets

PROTECTIVE SLEEVE FOR AN INSTRUMENT STRING AND ITS METHOD OF APPLICATION TO AN INSTRUMENT

RELATED APPLICATIONS

This Application is a Continuation-In-Part of application Ser. No. 09/776,597, which was filed on Feb. 5, 2001 now abandoned.

BACKGROUND OF THE INVENTION

1. Field of the Invention

In general, the present invention relates to instrument strings of the type that are most commonly used on modern electric guitars. More particularly, the present invention relates to guides that are used in conjunction with guitar strings to help the guitar strings resist breakage during use.

2. Description of the Prior Art

Hand strummed stringed instruments have been in existence for many centuries. During that period of time, such stringed instruments have evolved into many different forms. One of those forms came is the acoustical guitar. Acoustical guitars have a hollow body and a neck that extends from the body. A plurality of strings are strung from the neck across an opening in the body. As the strings are strummed, the vibration of the string resonates in the hollow body of the guitar, thus amplifying the sound of the string.

In an acoustic guitar, the strings are attached to the top of the neck with tuning pegs or geared tuning mechanisms. These devices are used to adjust the tension in the guitar strings. At the opposite end of the guitar strings, the strings attach to a saddle block that firmly anchors the guitar strings in place.

In the middle of the twentieth century, the design of guitars again evolved, thereby introducing the electric guitar. Originally, electric guitars where merely acoustical guitars with an acoustical transducer placed within the hollow body of the guitar. The acoustical transducer was connected to an electrical amplifier and a speaker that reproduced the sound of the guitar.

As electrical guitar designs matured, the entire design of the guitar was designed around its electrical components. In modern electrical guitar designs, the body of the guitar is no longer hollow. Rather the body of the guitar is solid. Positioned below the stings is now an electrical pick-up. The electrical pick-up directly converts the vibrations of the guitar strings into corresponding electrical signals that can be amplified, altered and broadcast by other electronic devices.

Along with the advent of the solid guitar body came a new way to mount guitar strings to the guitar body. Many modern electrical guitars have apertures formed through the solid body. The apertures have a diameter just wide enough to enable the passage of a guitar string through the aperture. Specialized guitar strings are produced for use with such electric guitars. The specialized strings terminate at one end with enlarged end caps. Such strings are shown in U.S. Pat. No. 5,913,257 to Schaller, entitled Method Of Manufacturing Guitar Strings And Guitar Strings Resulting From Such Method. The strings can pass through the apertures in the guitar, but the end caps cannot. As such, by threading such a specialized guitar string through an aperture in the guitar body, the guitar string becomes firmly anchored in place.

Electric guitar strings are passed from the rear of the guitar body toward the front of the guitar body. As the strings pass through the guitar body, the guitar strings fold over a bridge assembly before extending across the guitar body and up to the neck of the guitar. The bridge assembly in an electric guitar typically contains metal saddles. The guitar strings abut and bend against the saddles as the guitar strings turn toward the neck of the guitar.

As the guitar is played, the strings vibrate. Some of this vibration is experienced at the interface between the guitar strings and the saddles in the bridge assembly. As the guitar strings vibrate, the strings wear against the saddle. Furthermore, the point of contact against the saddle is a stress concentration point for the guitar strings. Eventually, the guitar strings wear to a point where the stress on the string causes them to break. The break on the string is typically right at the point where the string contacts the saddle.

In the prior art, there have been different techniques used that are intended to help a guitar string resist breakage. One technique is to reinforce the guitar string at the point where the guitar string contacts the saddle in the bridge assembly. Such prior art techniques are exemplified by U.S. Pat. No. 4,581,976 to Ball, entitled Reinforced Musical Instrument String. This technique works, however, the reinforcements add significantly to the cost of the guitar strings.

Another technique used to reduce guitar string breakage, is to increase the curvature of the saddle at the point where the string abuts the saddle. Such prior art techniques are exemplified by U.S. Pat. No. 4,960,027 to Dunwoodle, entitled Bridge For A Stringed Instrument. Such devices do reduce the number of guitar string breakages. However, the guitar string still does wear against a metal saddle and does eventually wear to a point of breakage.

Recognizing that wear is caused by the contact of the metal guitar string against the metal saddle, pads have been developed that are intended to be placed between the string and the saddle. Such prior art pads are exemplified by U.S. Pat. No. 5,465,643, entitled Guitar String Support. The problem associated with such pads is that they are very difficult to correctly position between the guitar string and the saddle. Furthermore, the pad conforms to the shape of the saddle, thus the guitar string still wears against a salient point. This often causes the pad to prematurely wear away. This effects the protection provided to the guitar strings by the pads and the tuning of the guitar strings.

A need therefore exists for a device that can prevent wear between a guitar string and a saddle of a bridge assembly, yet is easy to install and is inexpensive. This need is provided by the present invention as described and claimed below.

SUMMARY OF THE INVENTION

The present invention is a device and method for reducing wear and stress in the string of a stringed instrument, such as a guitar. Certain stringed instruments are strung by advancing strings through string apertures in the body of the instrument. The present invention device consists of tubular sleeves that are placed into the string apertures. As the instrument is strung, the strings of the instrument are tightened. When tightened, the strings abut against and bend around the tubular sleeves. Each tubular sleeve has a curved surface against which a string bends. This lowers stress concentrations in each string at the point of the bend. Furthermore, the tubular sleeves are made from a material that is softer than the material of the instrument's strings. Accordingly, as the instrument's strings wear against the sleeves, the sleeves experience the wear more so than the strings. By reducing the stress and the wear on the instrument's strings, the usable life of the instrument's strings is dramatically increased.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention device and method can be used on many stringed instruments, such as violins, banjos, mandolins and the like, the present invention device and method are particularly well suited for use on electric guitars. Accordingly, the illustrated examples of the present invention device will show applications where the device is being used to prolong the life of a guitar string strung onto an electric guitar.

Figure 1:
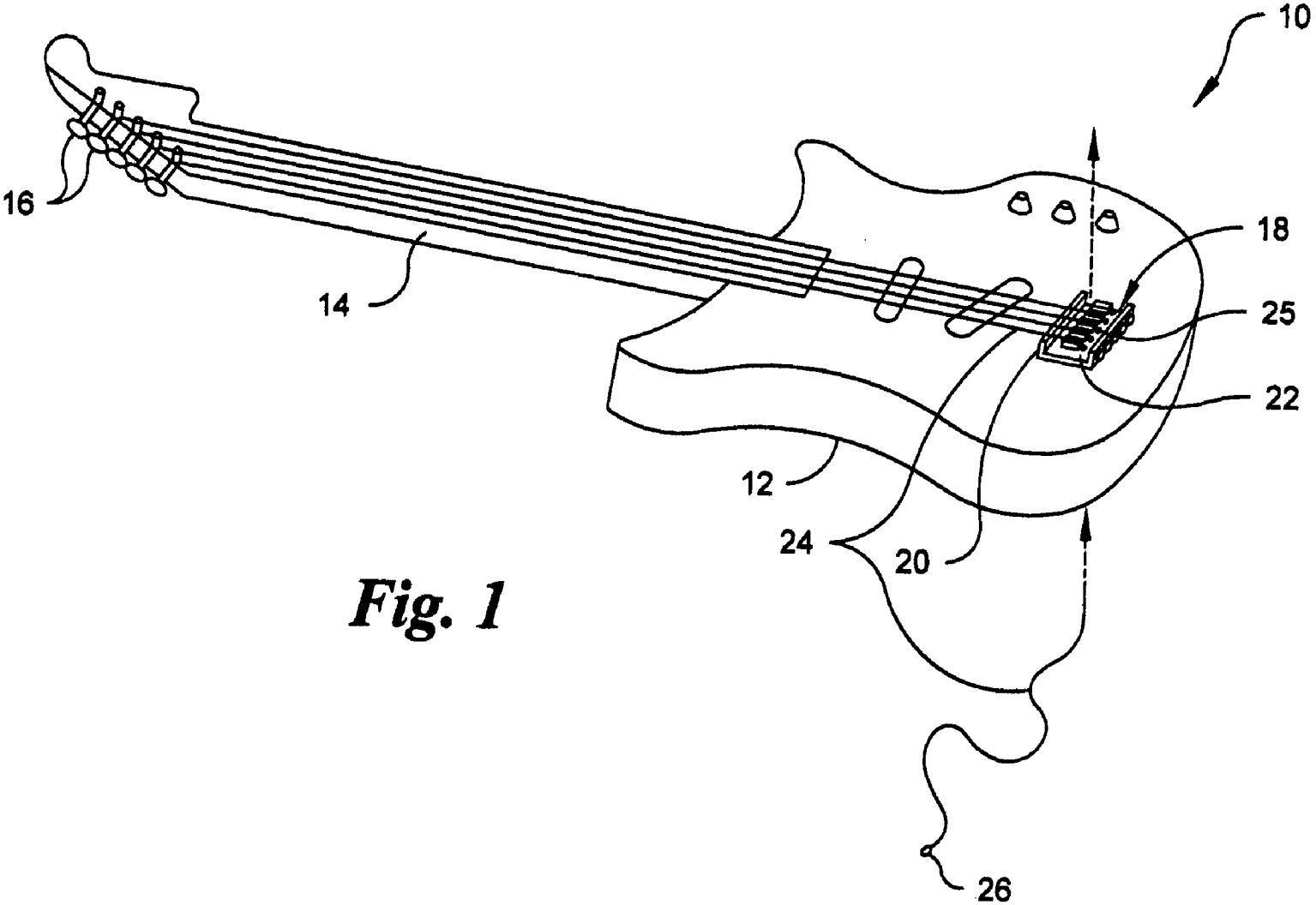
FIG. 1 is a perspective view of an electric guitar in accordance with the present invention.

Referring to FIG. 1, an exemplary embodiment of an electric guitar 10 is shown. The electric guitar 10 has a solid body 12 and a neck 14 that extends from the body 12. Geared tuning mechanisms 16 are attached to the end of the neck 14. Toward the bottom of the solid guitar body 12 is located a bridge assembly 18. The bridge assembly 18 includes a tremolo 20 and a set of saddles 22 for pulling the guitar strings 24 taut against the tremolo 20. Beneath the bridge assembly 18 is a bank of apertures 25. There is one aperture 25 for each string 24 of the guitar 10. The saddles 22 in the bridge assembly 18 align over the apertures.

The free end of the guitar strings 24 are passed through the apertures from the back side of the guitar body 12. Each of the guitar strings 24 terminates at one end with an enlarged end cap 26. The end cap 26 is too large to pass fully through the apertures 25 in the guitar body 12. The free end of each guitar string 24 is at the end of the guitar string 24 opposite the end cap 26. The free end of each guitar string 24 is passed fully through the guitar body 12. The free end of each guitar string 24 is then advanced through a corresponding saddle 22, over the tremolo 20 and to a corresponding geared tuning mechanism 16. As the tuning mechanisms 16 apply tension to each of the strings 24, the guitar strings 24 are pulled taut between the bridge assembly 18 and the geared tuning mechanisms 16.

Figure 2:
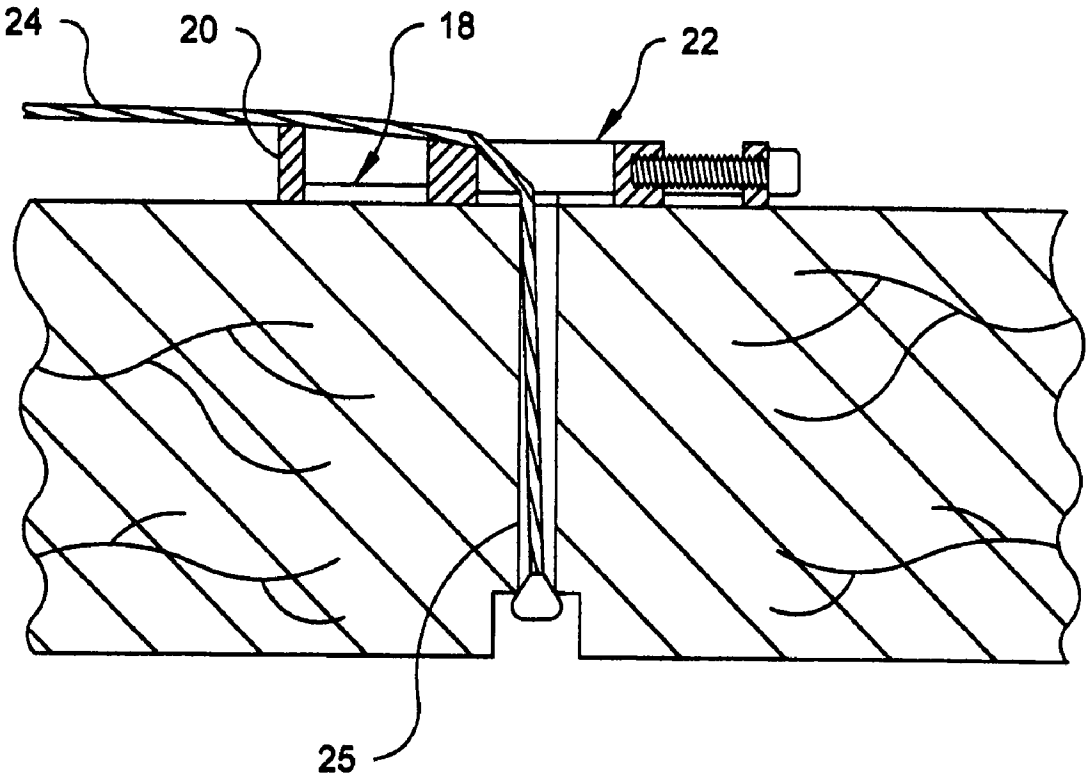
Fig. 2 (Prior Art)
FIG. 2 is a cross-sectional view of the area of a prior art electric guitar in the area surrounding the bridge assembly.

Referring to FIG. 2, it can be seen that with a traditional prior art configuration, each guitar string 24 extends through an aperture 25 and through the bridge assembly 18. Once the guitar string 24 is installed, the guitar string 24 is pulled taut over the tremolo and abuts against the corner of the saddle 22.

Figure 3:
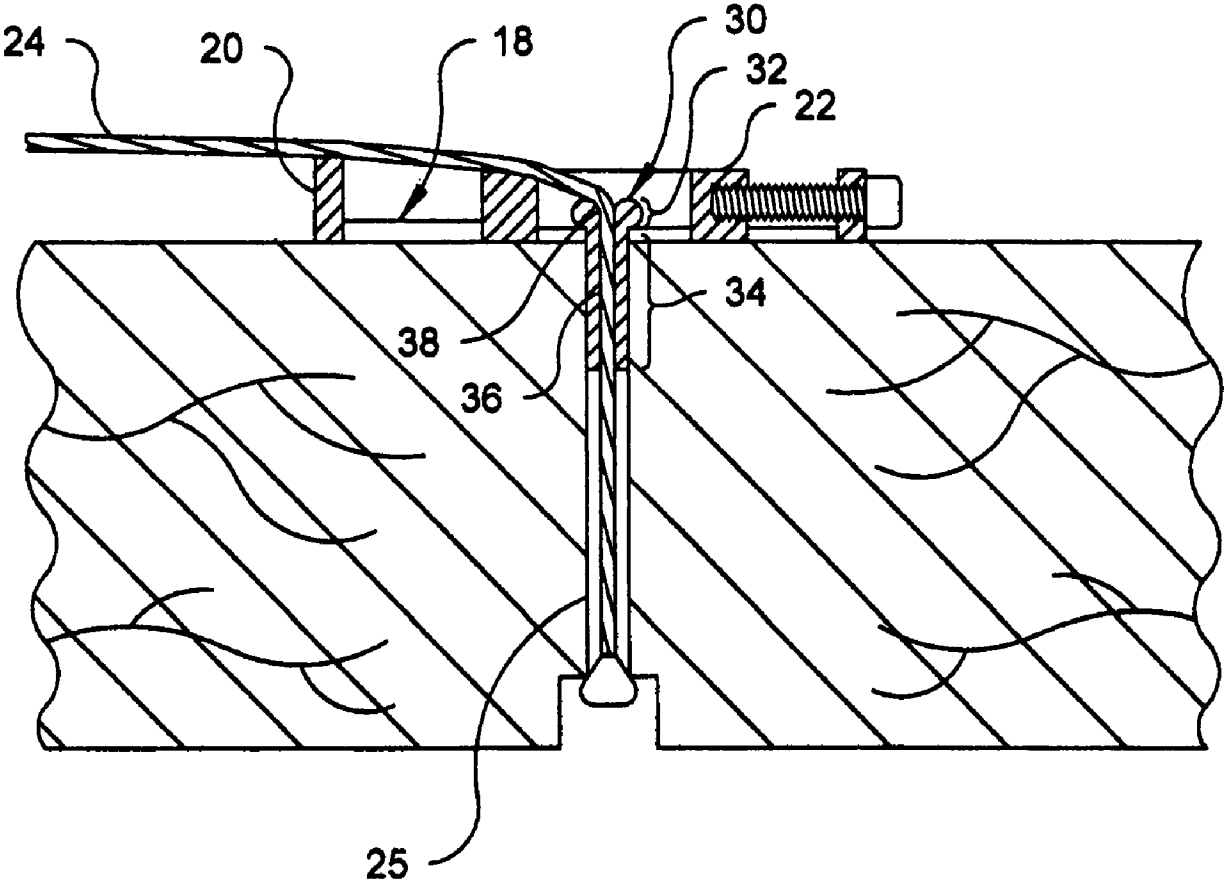
FIG. 3 is a cross-sectional view of the area of an electric guitar, in accordance with the present invention, in the area surrounding the bridge assembly.

Referring now to FIG. 3, it can be seen that the configuration of the present invention includes a protective tubular sleeve 30. The protective tubular sleeve 30 is made of a material that is softer than the metal of the guitar string 24. The tubular sleeve 30 can be made from a soft metal, such as brass, bronze, aluminum or an aluminum alloy. However, preferably, the tubular sleeve 30 is made of a synthetic material that is resistant to wear. Although compositions such as Kevlar, and Teflon can be used, a preferred material is Surlyn, which is the wear-resistant material commonly used on the exterior of modern golf balls.

The protective tubular sleeve 30 is comprised of a head section 32 and a neck section 34. The neck section 34 has an exterior diameter that is small enough to fit into a string aperture 25 in the solid body 12 of the guitar 10. The neck section 34 can have a constant external diameter or can be slightly tapered to help the neck section 34 pass into one of the apertures 25. The head section 32 of the protective tubular sleeve 30 is enlarged. The external diameter of the head section 32 is larger than that of the string aperture 25 in the guitar body 12. As such, when a protective tubular sleeve 30 is placed into one of the string apertures 25 in the guitar 10, the protective tubular sleeve 30 comes to rest in the string aperture 25 at the transition point between the head section 32 and the neck section 34 of the protective tubular sleeve 30.

On the interior of the protective tubular sleeve 30 is a conduit 36. The conduit 36 has a diameter large enough to accommodate a guitar string. A single sized conduit 36 can be used that is sized to accommodate the largest of the guitar strings, or different sized conduits 36 can be used that are sized to accommodate the different diameter strings 24 of the guitar 10.

The diameter of the conduit 36 is constant until the conduit approaches the top of the head section 32 of the protective tubular sleeve 30. At this point, the conduit flares out. The result is that a curved surface is formed on the inner edge 38 of the conduit 36 at the top of the head section 32. The curved inner edge 38 preferable has a radius of curvature at least as large as the diameter of the neck section 34 of the tubular sleeve 30.

To install the protective tubular sleeves 30, the strings 24 are removed from a guitar and the tubular sleeves 30 are inserted into the apertures 25 in the guitar 10. The protective sleeves 30 are inserted through the saddles 22, with the head sections 32 of the protective sleeves 30 facing upwardly. The free ends of the strings 24 are then advanced through the conduits 36 in the protective sleeves 30. In an alternate installation step, the free ends of the guitar strings 24 can first be advanced through the string apertures 25 in the guitar body 10. The protective tubular sleeves 30 can then be threaded onto the free ends of the strings 24. The strings 24 can then be used as guides to advance the protective tubular sleeves 30 down into the apertures 25 in the guitar body 10.

Once the protective tubular sleeves 30 are in place, the free ends of the strings 24 are advanced over the tremolo 20 and to the geared tuning mechanisms 16 (FIG. 1) on the neck of the guitar 10. As can be seen, once the protective tubular sleeves 30 are in place, each string 24 folds around the curved inner edge 38 of the protective tubular sleeve 30. As a result, each guitar string 24 is prevented from wearing against a salient point of the saddle 22. Furthermore, the metal strings 24 are wearing against the synthetic material of the tubular sleeves 30. Thus wear of the strings 24 themselves is reduced and the number of broken strings caused by wear and stress is proportionally reduced.

Furthermore, since the protective tubular sleeves 30 are tubular, they are symmetrically disposed around the guitar strings 24 within the apertures 25. Accordingly, they have no one proper orientation that must be adhered to during installation. This allows the protective tubular sleeves 30 to be rapidly and simply installed.

Figure 4:
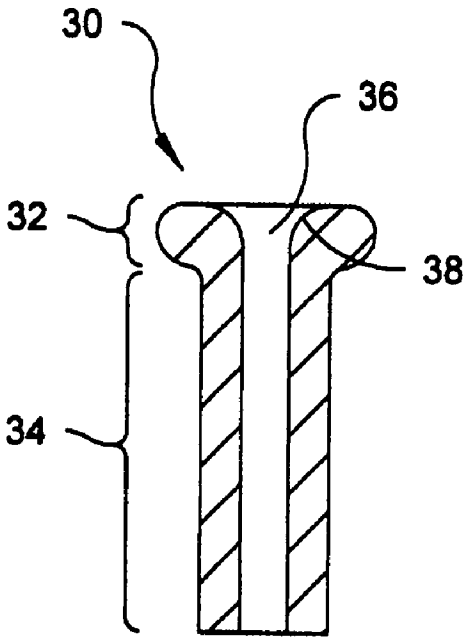
FIG. 4 is cross-sectional view of a tubular sleeve in accordance with the present invention.

Referring now to FIG. 4, it can be seen that each protective tubular sleeve 30 has a head section 32 with a certain diameter and a neck section 34 with a certain length. The length of the neck section 34 serves little purpose other than to hold the head section 32 concentrically within a guitar body string aperture. As such, the length of the neck section 34 of the protective tubular sleeve 30 can have any length greater than half the diameter of the head section 32. The maximum length of the neck section 34 is not to exceed the length of the string aperture into which the protective tubular sleeve 30 is being placed.

The conduit 36 defined by the tubular sleeve 30 expands as the conduit moves from the neck section 34 of the tubular sleeve 30 to the head section 32 of the tubular sleeve 30. This produces the curved inner edge 38 against which a guitar string is biased. The curved inner edge 38 has a radius of curvature at least as large as the diameter of the neck section 34 of the tubular sleeve 30. As a result, the curved inner edge 38 has no sharp corners against which a guitar string will wear.

From FIG. 4, it can be seen that each tubular sleeve 30 has a top end 41 and a bottom end 42, The central conduit 36 extends from the top end 41 to the bottom end 42. The central conduit 36 has a first diameter in the neck section 34 of the tubular sleeve 30. The central conduit 36, however, expands through the head section 32 to a larger second diameter at the top end 41. The expansion occurs along the curved inner surface 38. The top end 41 of the tubular sleeve 30 meets the curved inner surface 38 of the central conduit 36 at a tangent. As a result, there is a smooth curving transition from the top end 41 of the tubular sleeve 30 into the central conduit 36. No edges are therefore present against which the guitar string can wear.

The above embodiment described the use of metal guitar strings placed in a wooded guitar. Such descriptions are merely exemplary. The use of the tubular sleeves can also be used with plastic guitar strings and other synthetic material strings. Furthermore, the tubular sleeves can be used in instruments having metal or plastic bodies. The material of the instrument or string is not relevant. Rather, the present invention is directed toward relieving stress at the points where the strings abut against the instrument and cause wear in the string, It will be understood that the embodiment of the present invention device and method described is merely exemplary and a person skilled in the art can make many variations to the embodiment shown without departing from the scope of the present invention. For example, the prior art is replete with different types of synthetic materials that can be used in the fabrication of the tubular protective sleeves. Any such material can be used provided it is softer than the metal of the guitar string yet has an expected wear life longer than that of the guitar string. All such variations, modifications and alternate embodiments are intended to be included within the scope of the present invention as defined by the appended claims.

What is claimed is:

1. In an electric guitar of the type that is strung with guitar strings that terminate with end caps, wherein the guitar has a body with a front surface, a back surface and a plurality of cylindrical string apertures that extend through the body between the front surface and the back surface, wherein the cylindrical string apertures are sized to enable the guitar strings, but not the end caps, to pass therethrough, a method for preventing wear on each guitar string as it passes into one of the cylindrical string apertures, said method comprising the steps of:

providing a tubular sleeve having a neck section of a first external diameter and a head section of a larger second diameter, wherein said tubular sleeve defines a central conduit that passes through both said neck section and said head section;

sliding said neck section of said tubular sleeve within a cylindrical string aperture of the guitar, wherein said neck section passes freely into said cylindrical string aperture and said head section of said tubular sleeve remains external of said cylindrical string aperture on said front surface of the guitar;

passing a guitar string into said central conduit of said tubular sleeve through said neck section until the end cap of the guitar string contacts the back surface of the guitar; and tightening said guitar string to a proper tuned tension, wherein said string bends over said head section of said tubular sleeve.

2. The method according to claim 1, wherein said central conduit expands within said head section and creates a curved surface, wherein the guitar string is biased against said curved surface when said guitar string is tightened to said tuned tension.

3. The method according to claim 1, wherein said step of providing a tubular sleeve includes providing a tubular sleeve made of material that is softer than said guitar string.

4. The method according to claim 1, wherein said tubular sleeve is comprised of a synthetic material.

5. The method according to claim 4, wherein said synthetic material is selected from a group consisting of Teflon, and Kevlar.

6. The method according to claim 4, wherein said tubular sleeve is comprised of a soft metal selected from a group consisting of brass, bronze, tin alloys, aluminum, and aluminum alloys.

* * * * *